United States Patent [19]

Park

[11] 4,009,783

[45] Mar. 1, 1977

[54] FRICTION SEPARATOR

[75] Inventor: Joseph K. Park, Corvallis, Oreg.

[73] Assignee: The United States of America as represented by the Secretary of Agriculture, Washington, D.C.

[22] Filed: Oct. 2, 1975

[21] Appl. No.: 618,921

[52] U.S. Cl. ..... 209/108
[51] Int. Cl.[2] ..... B07C 5/06
[58] Field of Search ..... 209/108, 90, 100, 82, 209/116

[56] References Cited

UNITED STATES PATENTS 3,844,411 10/1974 Lewis ..... 209/90

*Primary Examiner*—Allen N. Knowles
*Attorney, Agent, or Firm*—M. Howard Silverstein; David G. McConnell

[57] ABSTRACT

Device for separating rough particles from smooth ones, for example, removing earth clods from beans. The device utilizes the principle that the rough particles display a higher degree of friction than do the smooth particles.

1 Claim, 5 Drawing Figures

FRICTION SEPARATOR

DESCRIPTION OF THE INVENTION

This invention relates to and has among its objects the provision of novel apparatus for sorting particles, especially for separating rough particles from smooth particles.

Further objects of the invention will be evident from the following description taken in conjunction with the annexed drawings, wherein.

In accordance with modern bean harvesting methods, the vines are severed from their roots and subjected to threshing to separate the beans from the pods and other plant material. In this operation bits of earth enter the thresher with the vines, and the threshing operations tend to form these soil particles into clods. Sieving operations are included in the threshing operation but are only partially effective to remove the clods; those clods which are approximately the same size as the beans are not separated by sieving. Thus the end product is often contaminated with these clods, thereby causing problems in the sale and utilization of the product.

A primary object of the invention is the provision of means for solving this problem in that the apparatus of the invention readily separates the clods from the beans, even those clods which are the same size as the beans.

The apparatus of the invention operates on the principle of separating rough from smooth particles. Since earth clods are rough while beans are smooth, the apparatus is especially useful for removing clods from beans. However, it is to be emphasized that use of the apparatus of the invention is not so restricted; the invention can be employed in any situation where rough and smooth particles need to be separated. Typical applications are in separating rough particles (such as stones, earth clods, bits of woody material, etc.) from smooth particles such as beans, peas, lentils, and the like. Another application is separating broken from whole kernels. Since broken kernels have sharp edges they are readily separated from the whole kernels which have relatively smooth (curved) edges. In this connection, the apparatus may be used for separating broken kernels from whole kernels in many different kinds of products such as corn, rice, wheat, and other cereal grains; beans, peas, lentils, and other legume seeds. Further applications of the invention will be obvious to those skilled in the art from the foregoing illustrations.

The structure of the apparatus of the invention and its operation are next explained in detail, having particular reference to the separation of clods from beans. It will be understood that this application of the invention is by way of illustration and not limitation.

Figure 1:
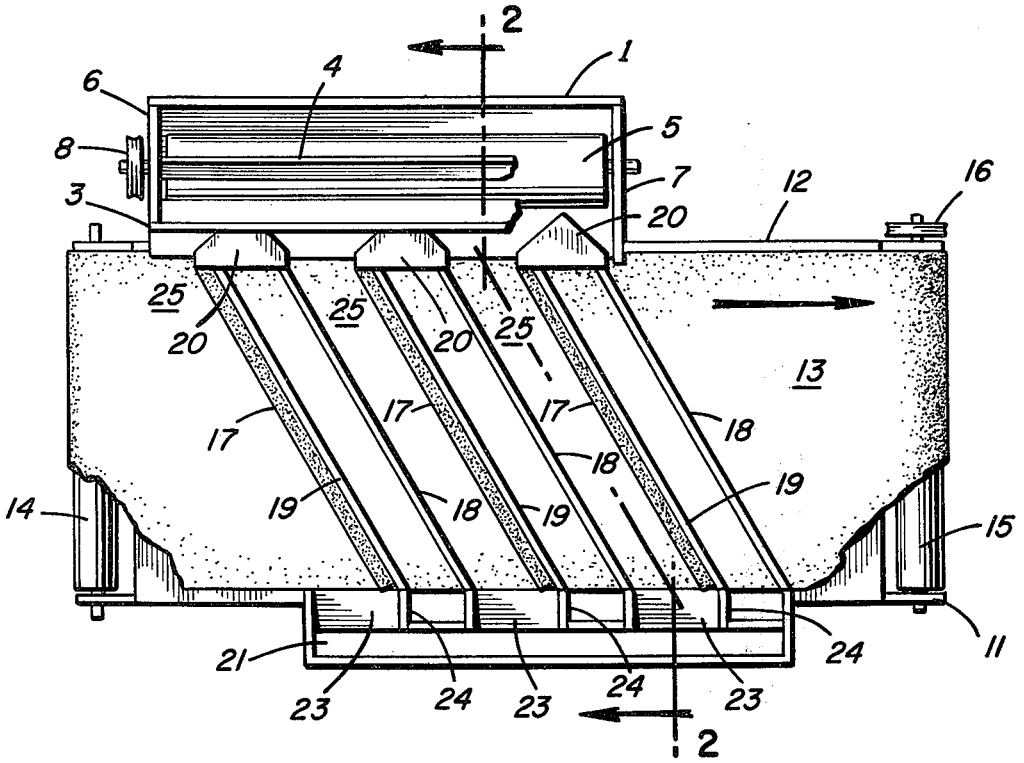
FIG. 1 is a plan view of the apparatus of the invention. In this figure parts have been broken away for purpose of illustration.
Figure 2:
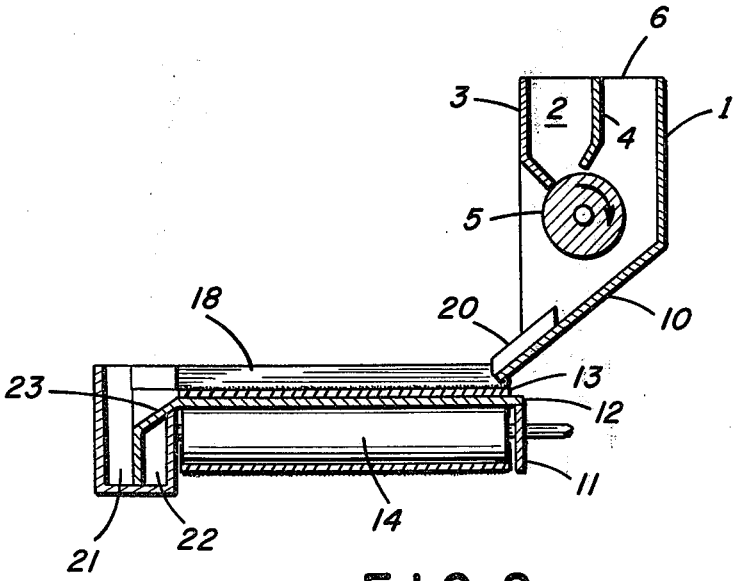
FIG. 2 is an end view, taken on planes 2—2 of FIG. 1.

Referring to FIGS. 1 and 2, the apparatus includes a feeder 1 which includes a hopper 2 established between plates 3 and 4. The material to be sorted is placed in hopper 2.

A feed roller 5, preferably having a grooved rubber surface, is mounted for rotation between end members 6 and 7. Roller 5 is rotated in the indicated direction by conventional means (not illustrated) applied to pulley 8. Rotation of roller 5 causes the material to be sorted to be fed at a predetermined rate onto inclined apron 10, whereby the material moves downwardly to the separation part of the apparatus.

The separation part of the apparatus includes a frame 11 which is provided with a flat bed 12 for supporting belt 13. The upper surface of bed 12 is preferably provided with a low-friction surface—such as an adhered film of polyethylene or the like —so that belt 13 can slide easily on bed 12.

Rotatably mounted on frame 11 are idler roller 14 and driven roller 15, the latter being rotated by conventional means (not illustrated) applied to pulley 16. Belt 13 is draped over rollers 14 and 15 and thus caused to traverse in the indicated direction. Belt 13 is usually made of textile material, for example, carpeting or other tufted textile fabric, upholstery fabric, or the like.

Mounted across the surface of belt 13 and at an angle of about 45′ to the length of belt 13, are a series of separators 17 and collectors 18. In the illustrated form of the apparatus only three of each of these elements is shown. This was done merely to simplify the drawing; in practice the apparatus is equipped with many more sets of these elements since the output increases with an increasing number thereof.

Figure 5:
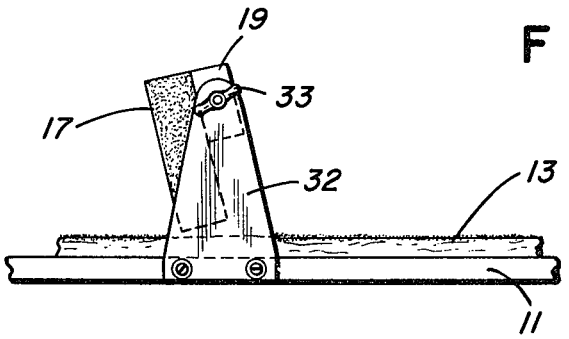
FIG. 5 is a diagrammatic side view illustrating the rotatable mounting of separator 17.

Separators 17 are usually made of a soft material such as sponge rubber or polyurethane foam. These elements co-act with belt 13 to separate rough and smooth particles, in particular, by permitting the rough particles to be conveyed under them while retaining smooth particles, all as hereinafter explained in detail. Since separators 17 are of a soft and flexible nature, they are maintained in position by adhering them to support bars 19. In the preferred modification of the invention, support bars 19 are rotatably mounted so that the angle between separators 17 and belt 13 can be varied. FIG. 5 illustrates how such rotatable mounting may be achieved. Reference numeral 32 indicates a bracket mounted on frame 11. Also provided on the opposite side of the device is a similar bracket 32, not shown in the drawing. These brackets are provided with thumbscrew arrangements 33, whereby the angle of separator 17 with respect to belt 13 can be varied as desired. It is obvious that enough brackets 33 are provided so that all the separators 17 can rotate to the desired angle.

Collectors 18 (in contrast to separators 17) are constructed of metal or other rigid material of construction since they merely serve to scavenge from belt 13 the particles which pass under the separators 17.

Figure 3:
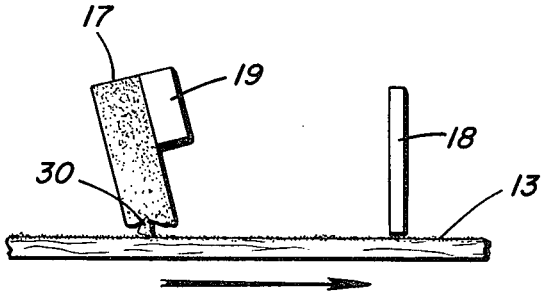
FIGS. 3 and 4 are diagrams illustrating the separation action of the apparatus.
Figure 4:
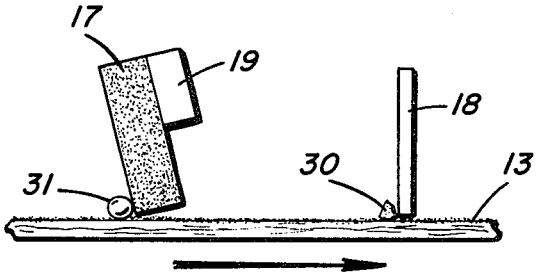

As shown in FIGS. 3 and 4, separators 17 and collectors 18 are mounted so that their bottom surfaces touch the top surface of belt 13. It is generally preferred that separators 17 be mounted with a slight tilt as shown in FIGS. 3 and 4.

Referring again to FIGS. 1 and 2, mounted on the side opposite feeder 1 are chambers for receiving the separated particles. Thus there is provided a chamber 21 for receiving the smooth particles. When such particles are directed off belt 13 by the action of separators 17, these particles slide down sloping plates 23 into chamber 21. Also provided is chamber 22 for receiving the rough particles via openings 24.

In operation, the particles to be separated move downwardly on apron 10 which is provided with triangular deflectors 20 so that the particles are fed onto belt 13 in front (upstream) of each separator 17, these entry positions being designated as 25 in FIG. 1. Considering one allotment of particles so introduced: By the action of belt 13 the particles are brought against the face of separator 17. Since the rough particles exhibit a high coefficient of friction they are gripped by the belt and carried under separator 17. The latter is of soft material so that it can deflect to allow such passage. With continued movement of the belt these rough particles are conveyed to succeeding collector 18 which serves to scavenge them off the belt and they drop through opening 24 into chamber 22. A different action occurs with the smooth particles. When these particles are moved up to separator 17 by belt 13, they slip on belt 13 because of their low-friction (smooth) surfaces. As a result, these smooth particles remain on the upstream side of separator 17. The continued traversal of belt 13 causes these particles to be moved to the side of the apparatus, whereby they slide down apron 23 into chamber 21.

The smooth particles which are collected in chamber 21 and the rough particles which are collected in chamber 22 can be separately removed from these chambers by any suitable means such as troughs, conveyor belts, or the like (not illustrated).

The separation action in accordance with the invention is further illustrated in FIGS. 3 and 4. In particular, FIG. 3 illustrates how rough particle 30 exhibits a high degree of friction so that it is carried by belt 13 under separator 17 which yields (deforms) to permit the particle to pass thereunder. FIG. 4 illustrates how smooth particle 31 provides little friction so that it slips on belt 13 and is therefore held back by separator 17. Rough particle 30, which has passed under separator 17, is retained against collector 18 since this member is of non-yielding construction.

Having thus described the invention, what is claimed is:

1. A device for separating rough particles from smooth particles, comprising in combination a. a flat belt for conveying the particles to be separated, the surface of said belt being constructed of a friction-creating material which will grip the rough particles having a high coefficient of friction but not the smooth particles having a low coefficient of friction, b. means for traversing said belt, c. means for feeding the particles to be separated onto said belt, d. a plurality of separators, each comprising a bar of yieldable material, mounted over said belt, parallel to and just touching the surface thereof, and extending at an angle of about 45° to the length of the belt, said separators cooperating with said belt to permit the rough particles gripped by said belt to be carried under said separators and to move the smooth particles not gripped by said belt to the side of said belt, e. means for receiving smooth particles which have been moved to the side of the belt, f. collector means after each separator cooperating with said belt to remove the rough particles which have been conveyed under said separator, and g. means for receiving the rough particles which have been removed from said belt.

* * * * *